US007730883B2

(12) United States Patent
Lawson et al.

(10) Patent No.: US 7,730,883 B2
(45) Date of Patent: Jun. 8, 2010

(54) BOW CAM PROTECTOR

(76) Inventors: Jerry Paul Lawson, 4674 W. Cholla Bluff Dr., Marana, AZ (US) 85653; Nathan E. Lawson, P.O. Box 85399, Tucson, AZ (US) 85754

( * ) Notice: Subject to any disclaimer, the term of this patent is extended or adjusted under 35 U.S.C. 154(b) by 428 days.

(21) Appl. No.: 11/562,764

(22) Filed: Nov. 22, 2006

(65) Prior Publication Data

US 2008/0115776 A1 May 22, 2008

(51) Int. Cl.
*F41B 5/14* (2006.01)

(52) U.S. Cl. ..... 124/86; 124/25.6

(58) Field of Classification Search ..... 124/25.6, 124/86

See application file for complete search history.

(56) References Cited

U.S. PATENT DOCUMENTS 2,968,300 A * 1/1961 Allen ..... 124/23.1
4,360,179 A * 11/1982 Roberts ..... 248/126
4,846,140 A 7/1989 DiMartino
4,979,488 A * 12/1990 Fenton et al. ..... 124/25.6
5,205,272 A 4/1993 Boyer
5,547,162 A 8/1996 Sobolewski et al.
6,205,992 B1 3/2001 Meeks et al.
6,216,680 B1 * 4/2001 Sanders ..... 124/86
6,749,170 B1 * 6/2004 Rhoads ..... 248/545
7,036,497 B2 5/2006 Horn
D530,387 S * 10/2006 Kennedy ..... D22/107
7,314,199 B1 * 1/2008 Ward ..... 248/166
2005/0150484 A1 7/2005 Horn

* cited by examiner

*Primary Examiner*—John Ricci
(74) *Attorney, Agent, or Firm*—Quarles & Brady LLP; Gavin J. Milczarek-Desai

(57) ABSTRACT

An article for protecting the cam of a compound bow that includes a member extending from a limb of the compound bow and disposed in overlapping arrangement with the cam. The member extends beyond the cam such that the cam is elevated from a surface upon which the compound bow is placed. The member is positioned at an angle of greater than 0 and less than 180 degrees relative to the bow limb such that the member may be used as a stand and to provide vibration dampening functions.

12 Claims, 3 Drawing Sheets

BOW CAM PROTECTOR

BACKGROUND OF THE INVENTION

1. Field of the Invention

The invention relates to an article that is especially useful for protecting the cam area of a compound bow from contact with the ground, for functioning as a compound bow stand, and for dampening vibration.

2. Description of the Related Art

A compound bow is a bow that has pulleys or cams at the end of each limb through which the bow string passes. As the string of the bow is pulled back (drawn), the pulleys or cams turn. The action of the cams reduces the amount of force needed to completely draw the bow. Compound bows also have the advantage of being less affected by changes in temperature and humidity such that superior accuracy, velocity, and distance are achieved in comparison to the traditional longbow.

In the most common compound bow models, there is the riser (body) into which limbs are attached. At the end of each limb there is a cam, the shape of which generally is round or oval but may vary. The cams normally have two concentric oval or more irregular shaped perimeters around which the string and cables go. Cables travel between the cams and at one end are attached to the string, while at the other end the cables are attached to the cam axles.

The materials from which a compound bow is made can be quite varied. The riser of compound bows is usually made of aluminum and magnesium, while the limbs to which the cams are attached typically are made of composite materials. Bowstring is normally made of high-modulus polyethylene.

Many devices for attachment to a compound bow are known to exist. For example, U.S. Pat. No. 7,036,497 discloses a bow stand that has a base that attaches to the riser and a pair of legs that attach to, and extend down from, a limb of the bow. While such a configuration may be suitable for its intended purpose, the invention of the '497 patent does not provide any direct protection or vibration dampening ability to the cam area.

U.S. Pat. No. 7,089,923 discloses a compound bow press that allows the user to relieve tension on the bow limbs such that the strings can be removed or the bow otherwise serviced. The press consists of two members that are mounted on a limb near each cam and that extend at a zero degree angle relative to the end of the limb. Due to this angle, each cam (and string) is left unprotected from contact with dirt or other foreign substances in the event that a user wants to set the limb end of the bow perpendicular to the ground (a common resting position).

Hence, it would be useful to have a simple and inexpensive all-in-one cam protector that additionally functions as a stand and a vibration dampener.

SUMMARY OF THE INVENTION

The invention involves a member extending from a limb of a compound bow and disposed in overlapping arrangement with a cam. The member extends beyond the cam such that the cam is elevated from a surface upon which the compound bow is placed.

In one embodiment, the member comprises a generally L-shaped member having a first section and a second section, with the first section being attachable to a limb of a compound bow the second section being formed such that it overlaps with the cam at an angle of greater than 0 and less than 180 degrees relative to the limb upon which the L-shaped member is attached. Hence, the L-shaped member can readily function as a cam protector and a stand for setting the bow on the ground in a substantially perpendicular "ready" position.

The member also may function as a vibration dampener. Preferably, the angle at which the member is disposed relative to the attached limb is between 75 and 115 degrees. Also, preferably, the member is formed from a single piece of material.

In another embodiment of the invention, an L-shaped member includes a third section and a fourth section, such that the cam of a bow is interposed between on side of the L-shaped member (i.e., the first and section sections) and the other side.

In yet another embodiment, an L-shaped member further includes an opening through which a cam axle may be concentrically disposed.

A clamping means for attaching the member to a limb also may be provided, especially in situations in which it is desirable to have the member be removable.

In still another embodiment of the invention, a compound bow is provided that includes a second member attached to the second limb of the bow and disposed in overlapping arrangement with a second cam at an angle of greater than 0 and less than 180 degrees relative to the second limb.

The invention also pertains to a kit for retrofitting a compound bow with a cam protecting apparatus having a member extending from the bow limb with the features described above.

Additional features and advantages of the invention will be forthcoming from the following detailed description of certain specific embodiments when read in conjunction with the accompanying drawings.

DESCRIPTION OF THE PREFERRED EMBODIMENTS

Figure 1:
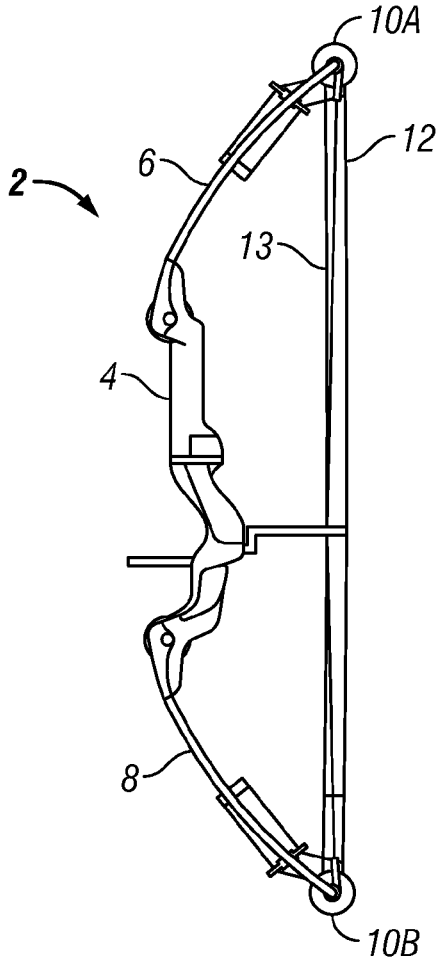
FIG. 1 (Prior Art)
FIG. 1 is plan view of a prior art compound bow.

Turning to FIG. 1, a prior art compound bow is illustrated. The bow 2 includes a riser 4 that is flanked by limb 6 and limb 8. At the end of each limb is a cam 10A and 10B that is mounted via an axle (not shown). A string 12 extends between the cams 10A and 10B, with a cables 13 extending between string 12 on one side and a cam axle on the other.

Figure 2:
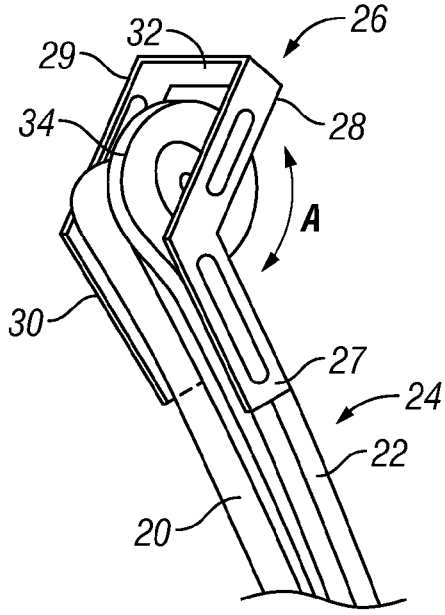
FIG. 2 is a partial perspective view of the cam area of a compound bow at which the apparatus of the invention has been attached.

FIG. 2 illustrates a first embodiment of the invention. Disposed proximal to the end of structures 20 and 22 of limb 24 is a generally L-shaped member 26 having a first section 27 and a second section 28 that are connected to a third section 29 and a fourth section 30 via crossbeam 32. First section 27 and fourth section 30 are adapted for attachment to structures 22 and 20, respectively, of limb 24. The means by which the relevant sections of L-shaped member 26 are attached may include bolts, epoxy, tape, frictional engagement, clamps and other coupling members. However, preferably the L-shaped member 26 is removable to assist in the maintenance of the bow.

Sections 28 and 29 of L-shaped member 26 are disposed in overlapping arrangement with cam 34 and such that the cam is interposed between these sections. Preferably, sections 28 and 29 radially extend beyond the cam 34 and are disposed at an angle A of greater than 0 and less than 180 degrees relative to limb 24 such that the L-shaped member 26 can function as a stand when the bow is resting on the ground in a substantially perpendicular position. To this end, having the angle of the radially extending sections be between 75 and 115 degrees is especially preferred because the bow remains in a "ready-to-use" position while protecting the cam area from contact with ground contaminants.

Figure 3:
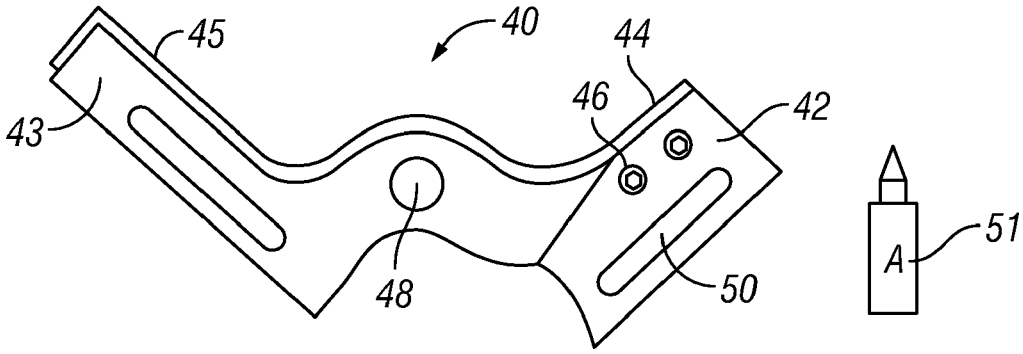
FIG. 3 is a side elevational view of a second embodiment of the invention.

Turning to FIG. 3, another embodiment of the invention is shown that may be part of a kit. The L-shaped member 40 includes a first section 42, a second section 43, a third section 44, and a fourth section 45. Sections 42 and 44 are joined by bolt 46, which also acts as a clamping means for attaching the L-shaped member 40 to a bow limb. Positioned between sections 42 and 43 is an opening 48 through which a cam axle may be concentrically disposed. Also shown is cavity 50, which helps to lighten the L-shaped member 40. A kit of the invention may further include an adhesive 51 to assist in the coupling of the member 40 to a bow limb should the means for attachment (such as bolt 46) not be sufficient.

Figure 4:
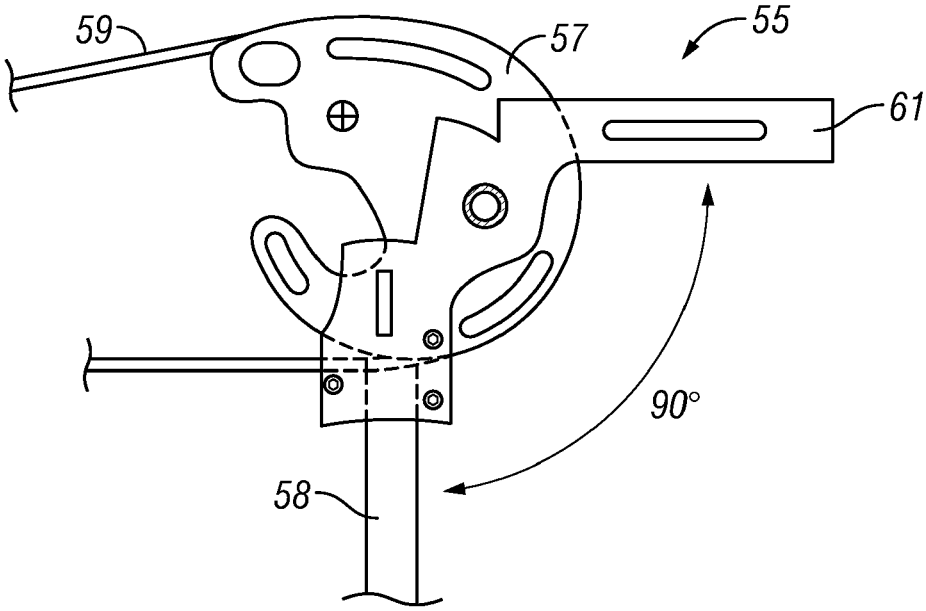
FIG. 4 is a side view of a third embodiment of the invention.

As seen in FIG. 4, the invention also includes an embodiment in which the L-shaped member 55 is a single piece mounted on only one side of a limb 58. Hence, cam 57 and string 59 are protected when the bow is placed on the ground via section 61 without the added weight of a "dual sided" L-shaped member.

Figure 5:
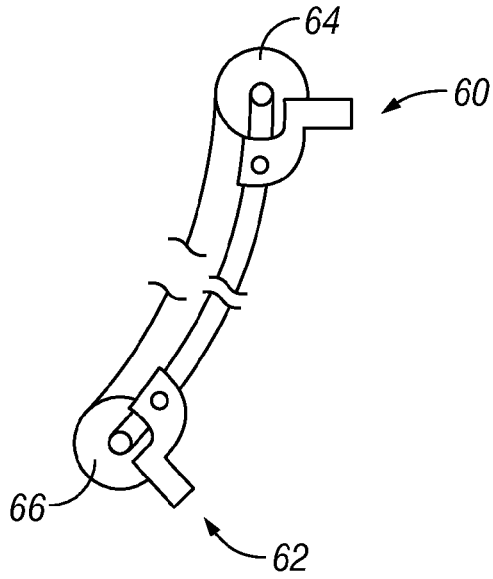
FIG. 5 is a partial schematic illustration of the two ends of a compound bow having apparatus of the invention attached.

FIG. 5 schematically depicts the ends of a compound bow having L-shaped members 60 and 62 disposed in overlapping arrangement with cams 64 and 66.

Figure 6:
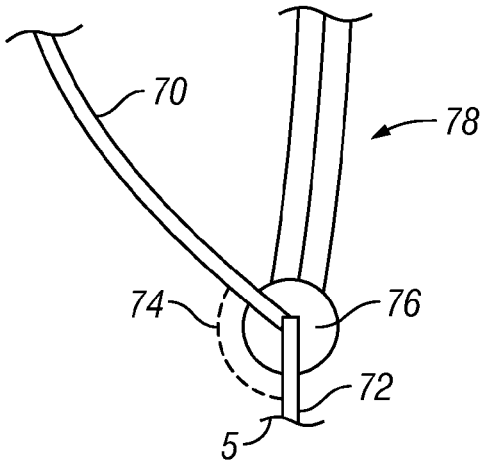
FIG. 6 schematically depicts a fourth embodiment of the invention.
Figure 7:
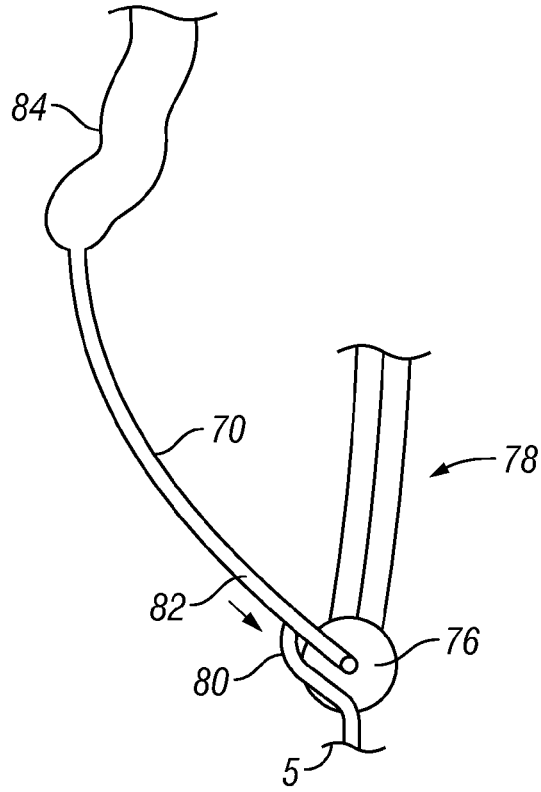
FIG. 7 schematically depicts a fifth embodiment of the invention.

FIGS. 6 and 7 illustrate two additional embodiments of the invention. In FIG. 6, limb 70 has a member 72 that extends from the limb at an angle of approximately 115 degrees relative to the limb 70 as indicated by numeral 74. The member 72 is disposed in overlapping arrangement with a cam 76 and extends beyond cam 76 such that the cam is elevated from a surface S upon which the compound bow 78 is placed. The member 70 may be integrally formed with the limb or may be attached.

In FIG. 7, a member 80 extends from limb 70. The member 80 is disposed in overlapping arrangement with the cam 76 and extends beyond cam 76 such that the cam is elevated from a surface S upon which the compound bow 78 is placed. For balance and performance reasons, the member 80 preferably extends from the lower one-third of the limb proximal to cam 76 and distal from riser 84 (i.e., the area designated by numeral 82).

Various modifications are possible within the meaning and range of equivalence of the appended claims.

We claim:

1. An apparatus attached to a compound bow for protecting a cam of said compound bow, comprising:

a generally L-shaped member having a first section and a second section, wherein said first section is adapted for attachment to a limb of said compound bow and said second section is disposed in overlapping arrangement with said cam at an angle of greater than 0 and less than 180 degrees relative to said limb when the L-shaped member is attached to the bow, and wherein said L-shaped member further includes an opening through which a cam axle is disposed.

2. The apparatus of claim 1, wherein said second section extends beyond said cam.

3. The apparatus of claim 1, wherein said angle is between 75 and 115 degrees.

4. The apparatus of claim 1, wherein said L-shaped member is formed from a single piece of material.

5. The apparatus of claim 1, wherein said L-shaped member further comprises a third section and a fourth section, said third section and fourth section being coupled to the first section and second section such that said cam is interposed between the second section and the third section when the L-shaped member is attached to the bow.

6. The apparatus of claim 1, wherein the first section includes a clamping means for attaching the L-shaped member to said limb.

7. The apparatus of claim 1, wherein said L-shaped member is removable.

8. A compound bow, comprising:

a bow having a cam disposed at each end; and a member extending from a limb of said compound bow and disposed in overlapping arrangement with said cam and extending beyond said cam such that the cam is elevated from a surface upon which said compound bow is placed, wherein said member comprises a generally L-shaped member having a first section and a second section, wherein said first section is coupled to a limb of said bow and said second section is disposed in overlapping arrangement with said cam, and wherein said L-shaped member further comprises a third section and a fourth section, said third section and fourth section being coupled to the first section and second section such that said cam is interposed between the second section and the third section.

9. The bow of claim 8, wherein said L-shaped member extends at an angle of greater than 0 and less than 180 degrees relative to said limb.

10. The bow of claim 8, wherein said angle is between 75 and 115 degrees.

11. The bow of claim 8, wherein said L-shaped member further includes an opening through which a cam axle is disposed.

12. The bow of claim 8, wherein the first section includes a clamping means for attaching the L-shaped member to said limb.

* * * * *